US007694841B2

(12) United States Patent
Hattori et al.

(10) Patent No.: US 7,694,841 B2
(45) Date of Patent: Apr. 13, 2010

(54) HOLDING CONTAINER, EXTERNAL CONTAINER FOR KNEADING AND TRANSPORTATION, AND KNEADING DEVICE

(75) Inventors: Eiji Hattori, Kyoto (JP); Masayoshi Matsumura, Takatsuki (JP); Kazuhito Shimizu, Kofu (JP); Toshiharu Osaka, Kushiro (JP); Tooru Ichikawa, Tokyo (JP); Masahiro Ito, Tokyo (JP); Yoji Tanaka, Yokohama (JP)

(73) Assignees: Sunstar Engineering Inc., Takatsuki-Shi (JP); Hosokawa Yoko Co., Ltd., Tokyo (JP)

( * ) Notice: Subject to any disclaimer, the term of this patent is extended or adjusted under 35 U.S.C. 154(b) by 1261 days.

(21) Appl. No.: 10/506,683

(22) PCT Filed: Aug. 30, 2004

(86) PCT No.: PCT/JP2004/012482

§ 371 (c)(1),
(2), (4) Date: Aug. 30, 2005

(87) PCT Pub. No.: WO2006/025088

PCT Pub. Date: Mar. 9, 2006

(65) Prior Publication Data

US 2006/0176762 A1 Aug. 10, 2006

(51) Int. Cl.

| | |
|---|---|
| ***B01F 11/00*** | (2006.01) |
| ***B65D 8/14*** | (2006.01) |
| ***B65D 21/08*** | (2006.01) |
| ***B65D 77/00*** | (2006.01) |
| ***B65D 77/04*** | (2006.01) |
| ***B65D 77/06*** | (2006.01) |

(52) U.S. Cl. ..... 220/605; 220/737; 220/648; 220/669; 366/112; 366/209

(58) Field of Classification Search ..... 220/737, 220/650, 621, 626, 605, 669, 648; 366/110, 366/112, 209

See application file for complete search history.

(56) References Cited

U.S. PATENT DOCUMENTS 1,216,022 A * 2/1917 Vail ..... 220/646

(Continued)

FOREIGN PATENT DOCUMENTS

JP 2001240035 * 9/2001

(Continued)

OTHER PUBLICATIONS

Machine translation of JP 3289192 made May 29, 2009, 13 pages.*

*Primary Examiner*—Tony G Soohoo
(74) *Attorney, Agent, or Firm*—Kratz, Quintos & Hanson, LLP

(57) ABSTRACT

In order to achieve a container which is convenient for carrying, delivery, transportation and storage of a viscous liquid, which can be disposed by being crushed to a small volume size when it has become empty, and which prevents twisting or rising up of the lower half of the container during a mixing of a viscous liquid, a container A holding liquid is used, wherein a ring-shaped rim frame 2 is provided on the upper end of a flexible tubular main body 1, a bottom plate 3 is fitted onto an opening at the lower end thereof, and at least one ring-shaped trunk section frame 4 is provided on the outer circumferential surface of said tubular main body 1.

12 Claims, 23 Drawing Sheets

U.S. PATENT DOCUMENTS

| | | | | | |
|---|---|---|---|---|---|
| 1,564,658 | A | * | 12/1925 | Xardell | 220/615 |
| 2,078,530 | A | * | 4/1937 | Courtright | 220/288 |
| 3,169,286 | A | * | 2/1965 | McFeaters | 220/611 |

FOREIGN PATENT DOCUMENTS

| | | | |
|---|---|---|---|
| JP | 3289192 | * | 3/2002 |
| JP | 2004-250102 | * | 9/2004 |
| JP | 2005-205201 | * | 9/2004 |
| JP | 2005-47628 | * | 2/2005 |
| WO | WO 02/24539 | * | 3/2002 |

* cited by examiner

HOLDING CONTAINER, EXTERNAL CONTAINER FOR KNEADING AND TRANSPORTATION, AND KNEADING DEVICE

TECHNICAL FIELD

The present invention relates to a container which can be used suitably for carrying, delivery, transportation, mixing, churning and storing a viscous liquid such as a sealant, adhesive, paint material, mortar, concrete, miso paste, mayonnaise type food product, cleaning material, shampoo, rinse, hair dressing, beverage and medical liquid, and to an external container for mixing and transportation which can be fitted onto the container and attached to and detached from an agitating platform of a prescribed mixing device, and to a mixing device for mixing viscous liquid that is filled into the container.

BACKGROUND ART

Japanese Patent No. 3289192 discloses: (1) a sealant container which can be inserted into an external container for mixing and transportation of a sealant that is attachable to and detachable from the agitating platform of a mixing device, the sealant container being formed, furthermore, with a rotation preventing engagement section in a required portion thereof in order to prevent it from rotating with respect to the external container for mixing and transportation; (2) an external container as described above for mixing and transportation of a sealant, into which the aforementioned sealant container can be inserted, and which is formed, furthermore, with a rotation preventing engagement section in a required portion thereof, in order to prevent it from rotating with respect the sealant container; and (3) a combination comprising the aforementioned sealant container and the aforementioned external container for mixing and transportation of a sealant.

Moreover, Japanese Patent Laid-open Publication No. H11-227766 discloses a flexible container made of plastic for holding various liquid materials, comprising a large-diameter ring-shaped section consisting of a molded plastic section provided about the upper end of a tubular main body made of a plastic laminate film, and a small-diameter ring-shaped section consisting of a molded plastic section provided similarly about the lower end of same, having a characteristic in that when the liquid material held in the container has been used and the container has become empty, it can be disposed of in a small volume size, by reducing the volume size of the empty container by crushing the large-diameter section and the small-diameter ring-shaped sections towards each other in such a manner they are brought close together or become joined together.

DISCLOSURE OF THE INVENTION

The present inventors and others investigated the recycling, reuse and reduction of containers, and particularly, the containers for holding viscous liquids, such as sealant, and they carried out thorough research into the practical application of such containers, focusing on beneficial features, such as the fact that using a flexible container made of plastic is convenient for carrying, delivery, transportation and storage of sealant, that the container can be crushed and disposed of in a small volume size when it has become empty, thereby reducing the volume size of industrial waste, and hence a partial contribution can be made towards reducing the burden on the earth environment, while also lower the costs.

However, if the aforementioned flexible container is used as a container for holding a sealant, then problems of the following kinds are occurred. More specifically, if the container for sealant is inserted into an external container for mixing and transportation, this external container is mounted onto and fixed to the agitating platform of a mixing device, and the sealant held in the container for sealant is mixed in a general method, then it is known that problems may occur, namely, that the flexible tubular main body of the container may twist, the lower half section of the container may rises upwards, and the container may be damaged or destroyed due to the container becoming wound about the paddles or coming into contact with the paddles.

The present invention was devised with the object of providing a container which can be used when mixing a viscous liquid, for example, in the case of a sealant, mixing the main material and the hardening agent, or, where necessary, mixing a coloring agent, catalyst, retarder, or the like, while maintaining the abovementioned beneficial features of a flexible container made of plastic, the container being convenient for use in carrying, delivery, transportation and storage of a sealant, being disposable by crushing it into a small volume size when it has become empty, and being environmentally friendly while allowing costs to be lower, and furthermore, it being possible to prevent deformation of a kind giving rise to the abovementioned problems during mixing, namely, twisting of the tubular main body of the container or rising up of the lower half of the container.

The container relating to the present invention comprises; a ring-shaped rim frame made of plastic is provided on the upper end of a flexible tubular main body, a bottom plate made of plastic is fitted onto at the other end thereof, and at least one ring-shaped trunk section frame is provided on the outer circumferential surface of the tubular main body, in addition to which, a plurality of first engaging projections are formed integrally with the ring-shaped rim frame in a projecting portion, at prescribed intervals, a downwardly extending engaging wall is formed integrally with the outer circumferential edge of the bottom plate, and a plurality of second engaging projections are formed integrally with the back side of the bottom plate.

In respective preferred embodiments of the present invention, the tubular main body of the container is made of a plastic laminate film, the ring-shaped rim frame has laterally-orientated T-shaped cross-section, in which an upper rib and a lower rib are continuously formed on the inner circumferential edge of a brim section, and the bottom plate comprises a circular plate and an upper side rib extending upwards from the outer circumferential edge of the circular plate, grips are formed in a projecting portion on the brim section of the ring-shaped rim frame, and the container is holding a viscous liquid.

The external container for mixing and transportation relating to the present invention is detachably fitted onto the aforementioned container and used for mixing the contents of the container and transporting the container, comprising a trunk wall and a circular bottom plate made of hard plastic, a plurality of engaging recesses into which the first engaging projections of the container can be fitted being formed at prescribed intervals on a ring-shaped rim section formed on the upper end section of the trunk wall, in addition to which, an inner ring groove into which the engaging wall of the container can be engaged is formed in the boundary region between the trunk wall and the circular plate of the container at the lower end of the container, and a plurality of engaging holes into which the second engaging projections of the container can be engaged are formed at prescribed positions in the back side of the circular bottom plate.

Here, in respective preferred embodiments of the present invention, peep holes are provided at prescribed positions in the trunk wall, air holes are provided on the circular bottom plate, cutaway sections which are open on the upper edge side are formed on the ring-shaped rim section, a difference in level is provided in the outer circumferential surface of the trunk wall, and the external diameter at the lower end side is made smaller than the internal diameter at the upper end side, and a lifting handle having bag hanging projections is attached rotatably to the ring-shaped rim section and a projecting piece for holding the lifting handle in an upright state is also formed thereon.

The mixing device relating to the present invention comprises; an agitating platform for fixing the aforementioned external container for mixing and transportation, the mixing device to mix the contents of the container by causing the external container and the container to fix with the agitating platform at getting out of place; comprising a plurality of fastening means for fastening the trunk wall of the external container, thereby detachably fixing the external container to the agitating platform.

EFFECTS OF THE INVENTION

According to the container relating to the present invention, since the tubular main body of the container is flexible, after the contents of the container have been used up, the container can be disposed of by crushing the tubular main body, disposing the waste easier and reducing the volume size of the wastes, and thus making it possible to reduce the burden on the earth environment.

Although a low viscous liquid may also be held in the container, generally the contents of the container are a viscous liquid, such as sealant, adhesive, paint, or the like, formed by a rubber or polymer composition, or a foodstuff, adhesive, shampoo, rinse, hair dressing, beverage, medical liquid, or the like, and regardless of whether or not mixing is required, such liquids can be held, carried out, delivered, transported, stored and mixed in the container.

According to the external container relating to the present invention, when the container is fitted into the external container, the first engaging projections in the upper end section of the container enter into the engaging recesses, the engaging wall on the outer circumference of the lower end of the container fits into the inner ring groove, the second engaging projections in the circular bottom plate of the external container enter into the engaging holes, and hence the upper end section and the lower end section of the container are engaged in a non-rotatable state with respect to the external container. Therefore, twisting of the tubular main body is reliably prevented during mixing of the contents by rotation of the paddle, and furthermore, rising up of the lower half of the container is also prevented. Consequently, it is possible reliably to prevent the tubular main body of the container from coming into contact with or becoming wound able the paddle, and thus to prevent the container from being damaged or broken.

LIST OF ELEMENTS

Figure 1:
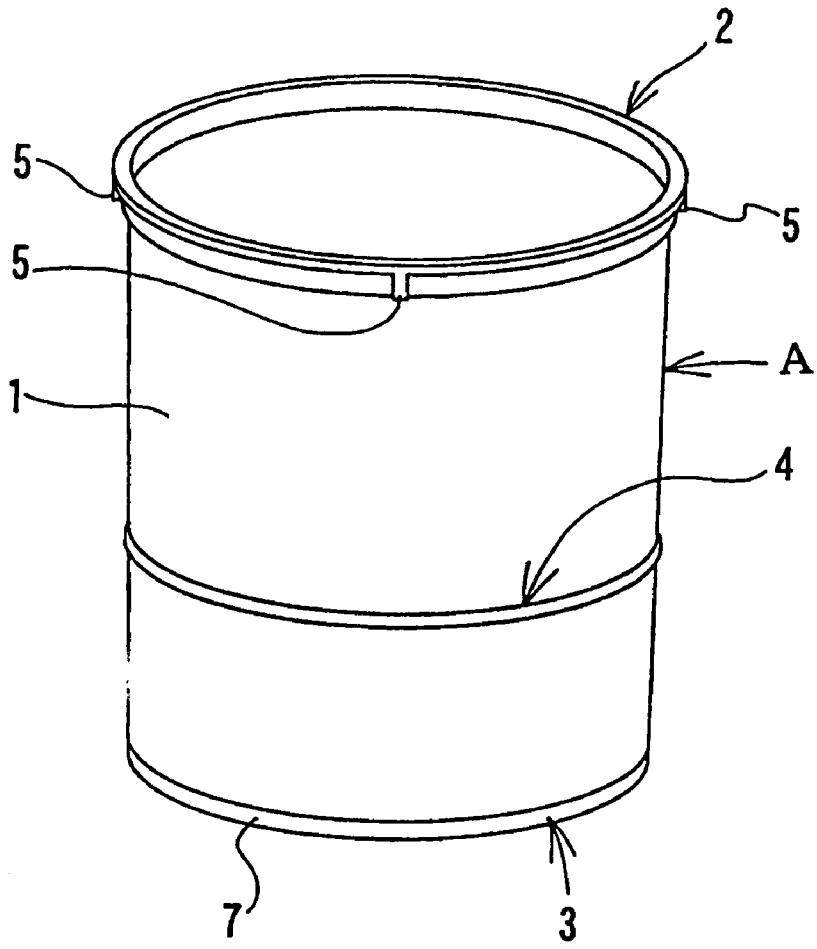
FIG. 1 is a perspective diagram of a container relating to a first embodiment of the present invention.
Figure 2:
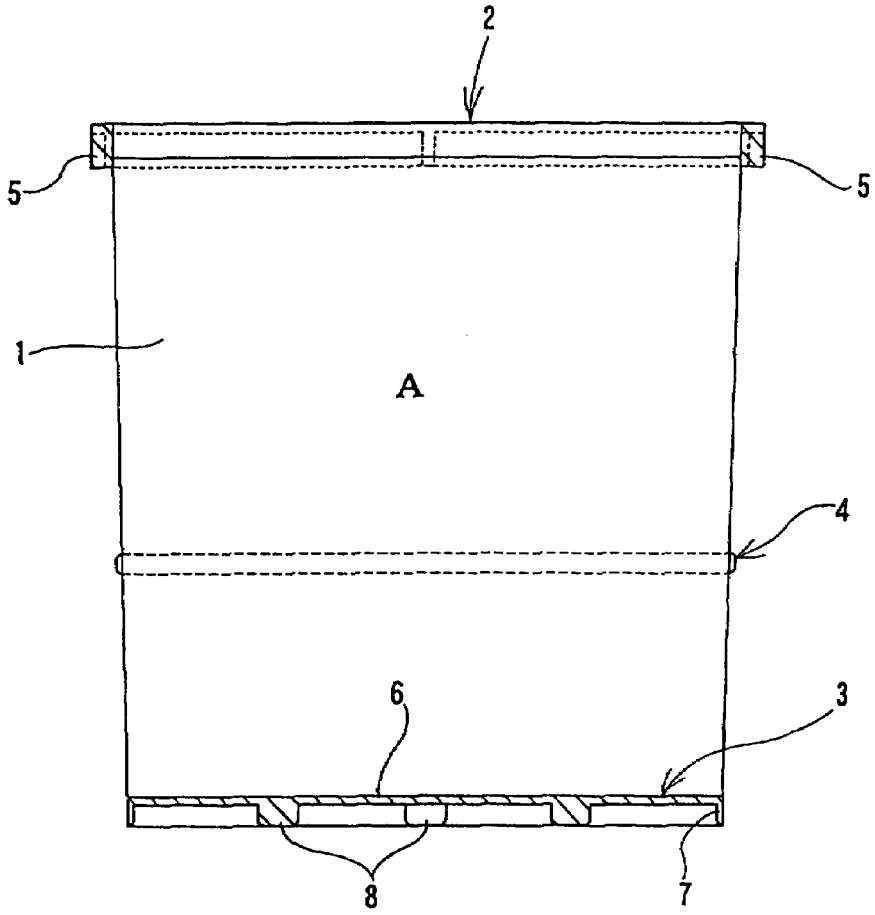
FIG. 2 is a vertical sectional view of the aforementioned container.

A, D container
B, E external container
C mixing device
1, 21 tubular main body
2, 22 ring-shaped rim frame
3, 23 bottom plate
4, 24 ring-shaped trunk section frame
5, 25 first engaging projection
7, 27 engaging wall
8, 28 second engaging projection
9, 29 trunk wall

10, 30 circular bottom plate
11, 31 ring-shaped rim section
12, 32 lifting handle
13, 33 engaging recess
14, 34 inner ring groove
15, 35 engaging hole
16 score line
17 pressing piece
18 agitating platform
19 fastening means
20 paddle
36 engaging hole reinforcing wall
37 ring-shaped reinforcing member
38 plinth
39 air hole

BEST MODE FOR CARRYING OUT THE INVENTION

Below, a preferred mode for executing the present invention is described with reference to the embodiments, but the present invention is not limited to this.

First Embodiment

Firstly, a first embodiment of the present invention is described with reference to FIG. 1 to FIG. 11.

Symbol A in the drawings indicates a flexible container made of soft plastic.

This container A is formed by fixing a plastic ring-shaped rim frame 2 onto the upper end of a flexible tubular main body 1, which decreases gradually in diameter from the side of the upper end opening thereof towards the lower end opening thereof, and the ring-shaped rim frame 2 and the tubular main body 1 form an integrated body, and furthermore, affixing a plastic bottom plate 3 to the lower end opening and forming at least one ring-shaped trunk section frame 4 having a band-shape, made from plastic, metal, leather, cloth, or the like, on the outer circumferential surface of the tubular main body 1. In the container according to the present embodiment, one plastic ring-shaped trunk section frame 4 is provided integrally with the outer circumferential surface of the tubular main body in approximately the middle portion thereof in the height direction. Furthermore, the tubular main body 1 is made from a plastic laminate film wherein a metal foil, such as aluminum foil, or the like is laminated between films of synthetic resin, such as polyethylene, polypropylene, polyester or nylon, for example.

The ring-shaped rim frame 2 comprises of a ring-shaped member having an inverted L-shaped cross-section, a plurality of first engaging projections 5 being formed in a projecting position at prescribed intervals, for example, intervals of 90°, on the outer circumferential surface of the ring-shaped rim flame.

The bottom plate 3 comprises a circular plate 6, an engaging wall 7 formed integrally with the outer circumference of the circular plate, and a plurality of second engaging projections 8 formed at prescribed positions integrally with the back side of the circular plate.

Figure 3:
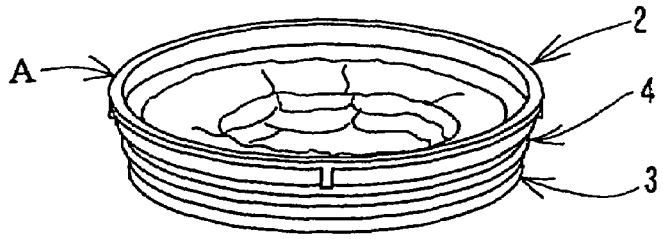
FIG. 3 is a perspective diagram of the aforementioned container in a crushed state.
Figure 4:
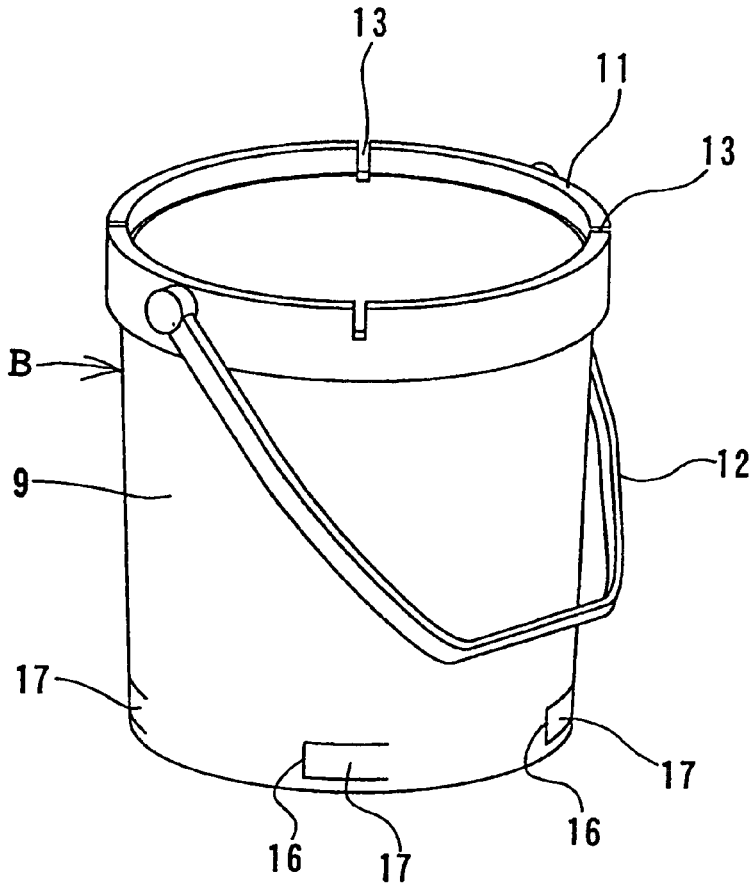
FIG. 4 is a perspective diagram of an external container relating to the first embodiment of the present invention.
Figure 5:
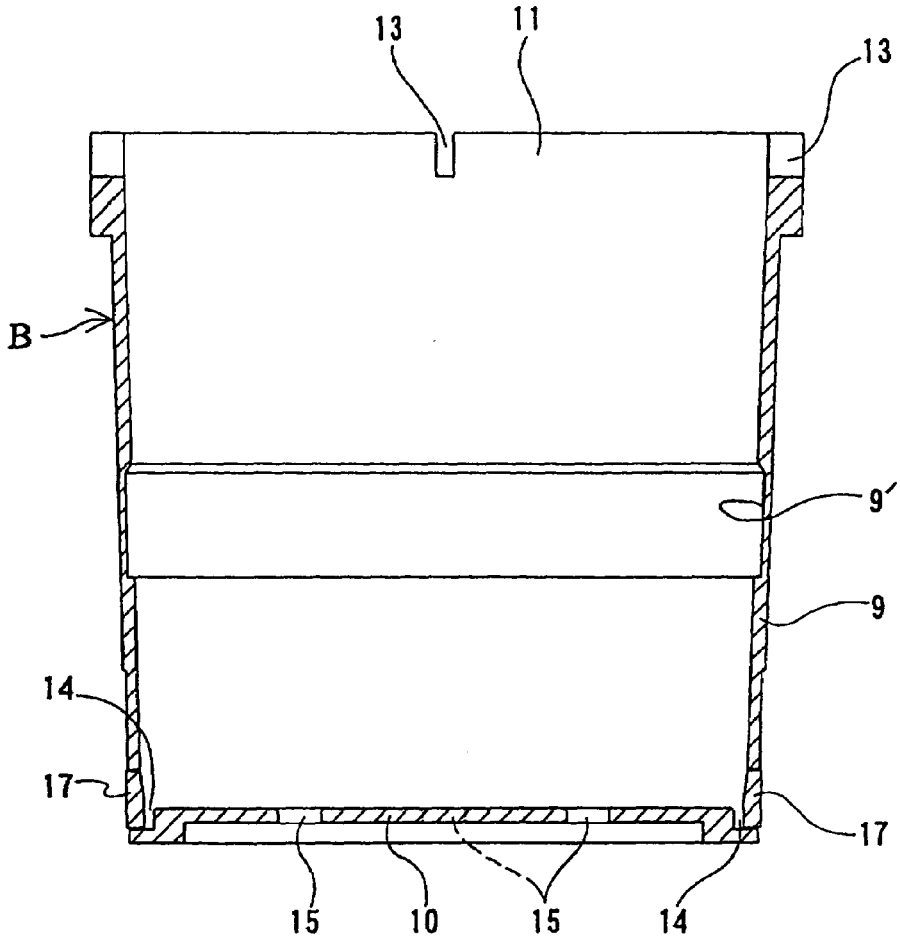
FIG. 5 is a vertical sectional view of the aforementioned external container.

This container A is filled with a prescribed viscous liquid forming contents, whereupon the upper end opening is closed with a prescribed lid member (not illustrated) and the container is accommodated inside a packaging box, such as a cardboard box, or the like. In this state, it is supplied for carrying, delivery, transportation, or storage. When the viscous liquid has been used up and the container has become empty, by crushing the container in such a manner that the ring-shaped rim frame 2 and the bottom plate 3 move towards each other, or come into contact with each other, the tubular main body 1, which assumes a folded state, the ring-shaped trunk section frame 4, the ring-shaped rim frame 2 and the bottom plate become folded together, the height of the container is reduced to small fraction of its original height, and hence the volume size of the resulting industrial waste can be reduced (FIG. 3).

Symbol B in the diagram is an external container made from a hard plastic.

This external container B comprises a trunk wall 9 which decreases gradually in diameter from the side of the upper end opening thereof towards the lower end opening side, and a circular bottom plate 10 which closes the lower end section of the trunk wall 9, and it is constructed to a prescribed size such that it can be fitted onto the container A. A large diameter section 9' is provided in a middle step section of the inner face of the trunk wall 9, a ring-shaped rim section 11 is provided on the upper end of the trunk wall 9, and a lifting handle 12 is attached rotatably to the ring-shaped rim section 11.

Moreover, a plurality of engaging recesses 13, into which the aforementioned plurality of first engaging projections 5 of the container A can be inserted and engaged, are formed at prescribed intervals in the ring-shaped rim section 11.

The circular bottom plate 10 formed integrally with the trunk wall 9 forms a false bottom, and furthermore, between the inner surface of the trunk wall 9 and the circular bottom plate 10 of the external container B, an inner ring groove 14 is formed into which the aforementioned engaging wall 7 in the bottom plate body 3 of the container A can be inserted and engaged. Moreover, a plurality of engaging holes 15 for inserting and engaging the plurality of second engaging projections 8 of the container A are provided at prescribed locations in the circular bottom plate 10.

Furthermore, a plurality of pressing pieces 17 are formed on the trunk wall 9 in a plurality of positions near the lower section thereof and opposing the aforementioned inner ring groove 14. These pressing pieces 17 form pressing means for sandwiching and fixing the engaging wall 7 when it is inserted into the inner ring groove 14. In this embodiment, by forming laterally elongated C-shaped incisions 16 which surround the pressing pieces 17, the pressing pieces 17 are made to be slightly thicker than the other portions of the trunk wall 9 apart from the pressing pieces 17, in such a manner that the inner surfaces thereof can be deformed slightly towards the inside of the inner ring groove 14, by pressing from the outer side.

The pressing means 17 is not limited to the pressing pieces of the present embodiment, and other compositions may be adopted, provided that they have an action of sandwiching and fixing the engaging wall provided on the outer circumference of the bottom plate of the container.

The container A is filled with a prescribed viscous liquid and closed up, it is accommodated in a packaging box, or the like, and supplied for carrying, delivery, transportation or storage, if a viscous liquid is used, then the container A may be removed from the aforementioned packaging box, inserted into the external container B, and the viscous liquid may be subjected to prior mixing, by means of a mixing device C, as described below.

The container A is inserted into the external container B in the following manner.

Figure 6:
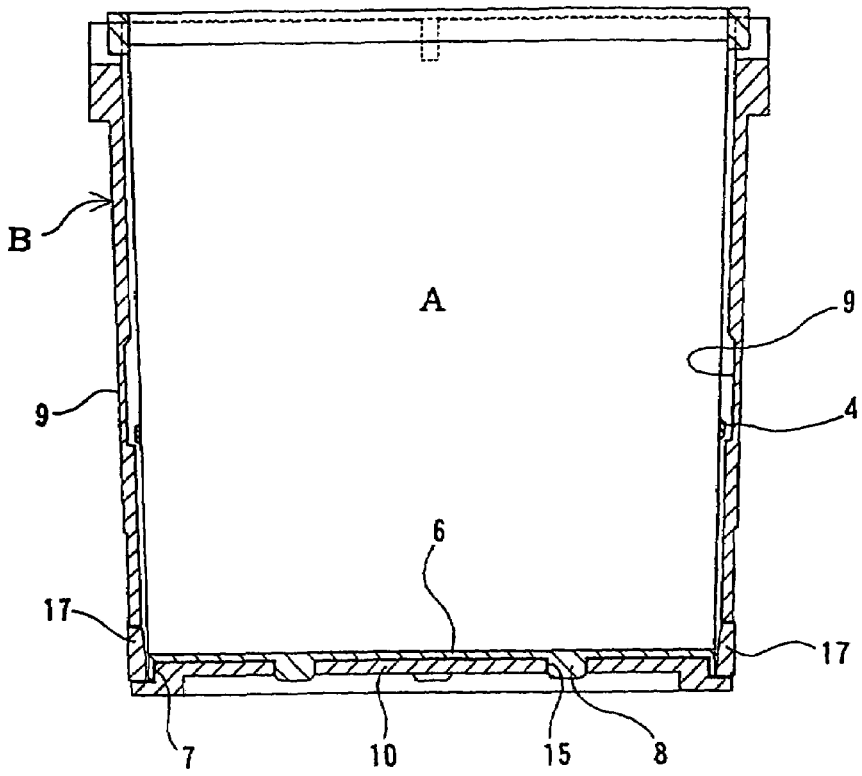
FIG. 6 is a vertical sectional view of the aforementioned container when inserted into the aforementioned external container.
Figure 7:
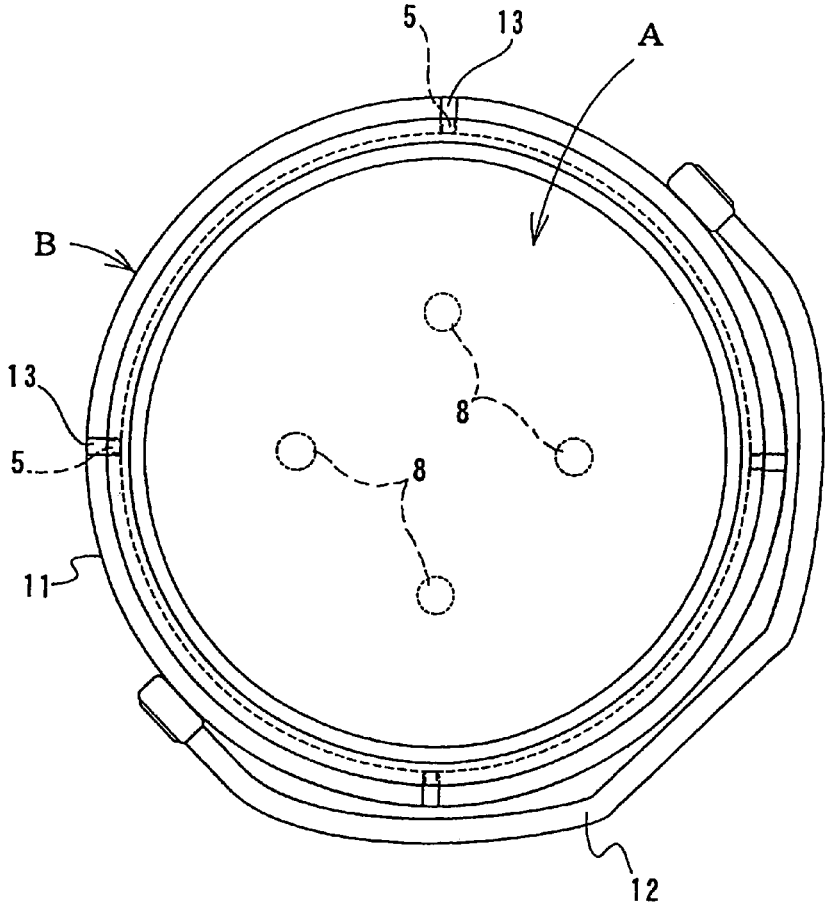
FIG. 7 is a plan view of the aforementioned container.
Figure 8:
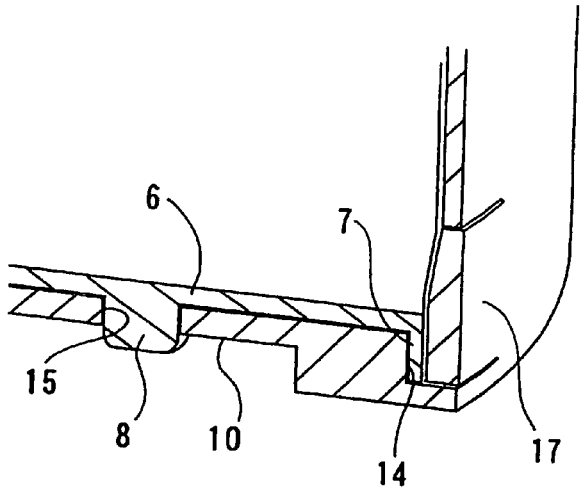
FIG. 8 is a vertical sectional perspective view of a principal part, showing the state of engagement between the container and the circular bottom plate of the external container for mixing.
Figure 9:
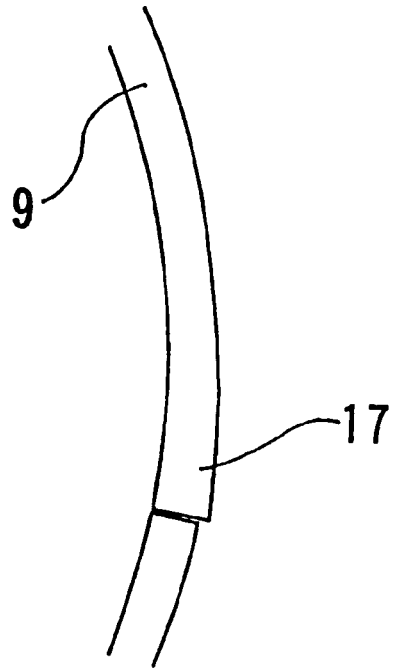
FIG. 9 is a lateral sectional view of a further principal part of the above.
Figure 10:
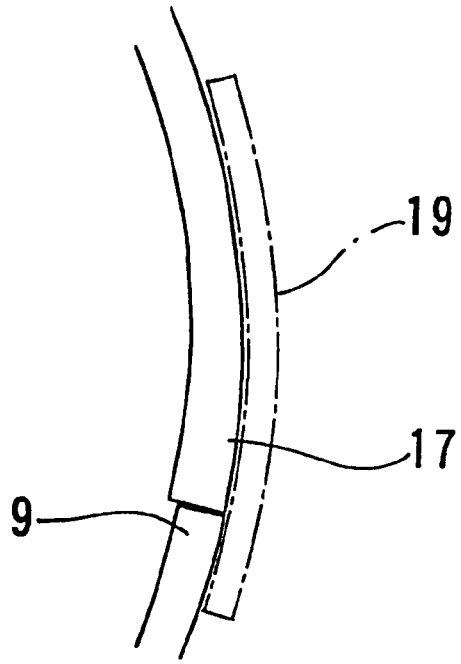
FIG. 10 is a lateral sectional view of the same principal part.

Specifically, in a state where the ring-shaped rim frame 2 of the container A is mounted on the ring-shaped rim section 11 of the external container B, the plurality of first engaging projections 5 are aligned with and inserted into the plurality of engaging recesses 13. Accordingly, the engaging wall 7 and the plurality of second engaging projections 8 of the container A are respectively inserted into the inner ring groove 14 and the plurality of engaging holes 15 and become engaged with same in a virtually hermetic condition, and the bottom plate (circular plate 6) of the container assumes a position on top of the circular bottom plate 10 of the external container B. Furthermore, the ring-shaped trunk section frame 4 of the container A assumes a position opposing the large diameter section 9' of the external container B (FIG. 6).

In order to perform mixing of the contents, such as the viscous liquid, the aforementioned external container B having the container A is mounted onto the agitating platform 18 of a commonly known mixing device C, for example, and at least one portion of the trunk wall of the external container B is fastened by a plurality of fastening means, thereby detachable and fixing the external container B to the agitating platform 18.

Figure 11:
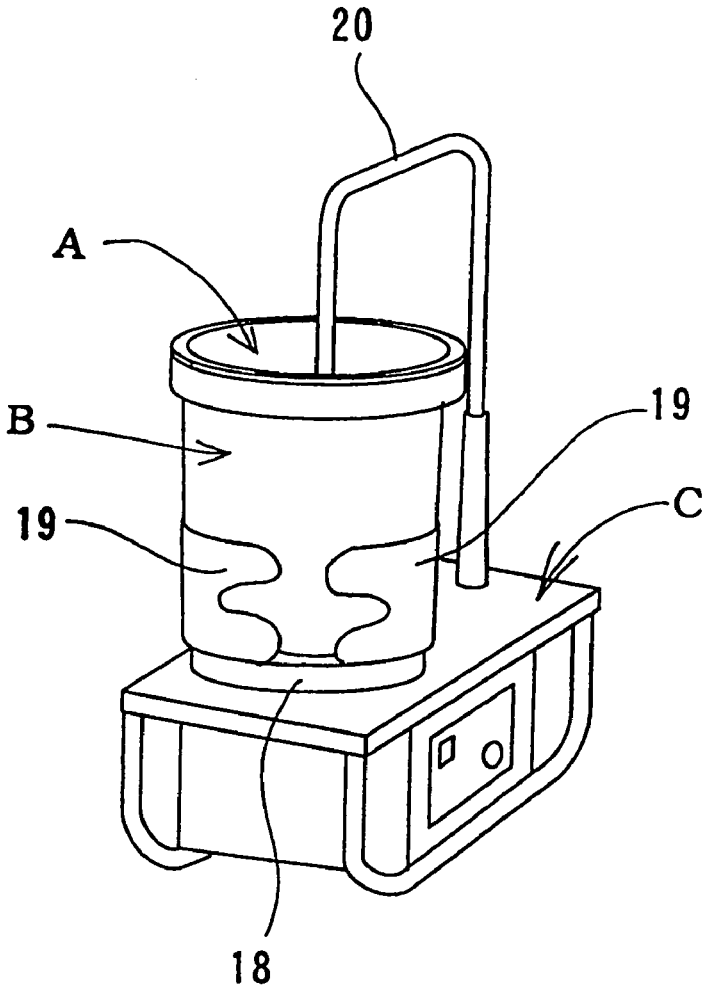
FIG. 11 is a perspective diagram of a state where an external container into which a container is fitted, is mounted on a mixing device and a paddle is set in position.
Figure 12:
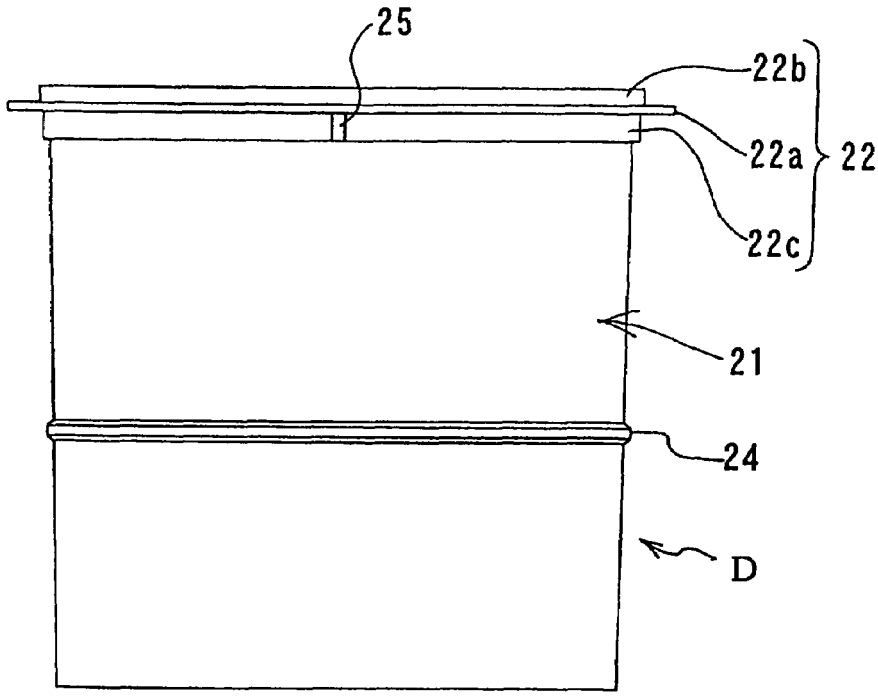
FIG. 12 is a front view of a container relating to a second embodiment of the present invention.
Figure 13:
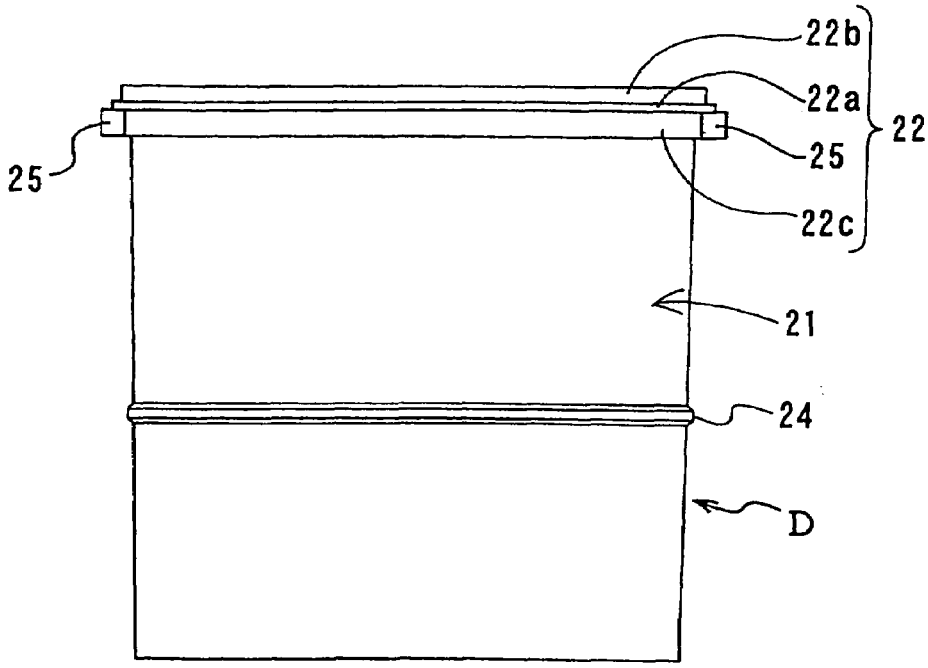
FIG. 13 is a side view of the above.
Figure 14:
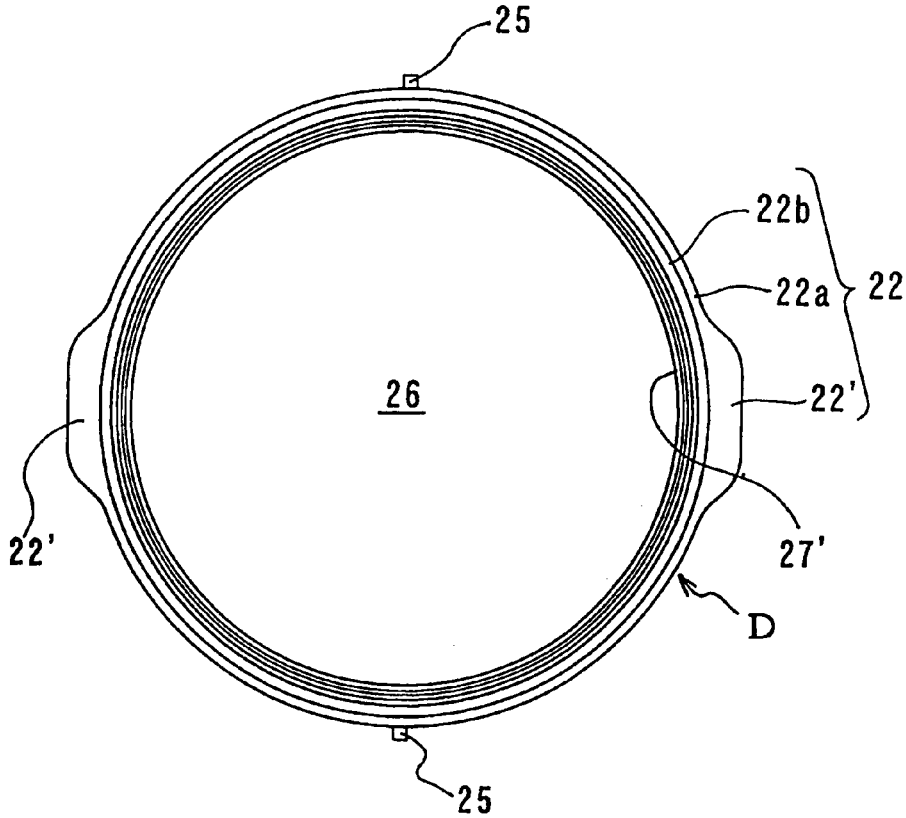
FIG. 14 is a plan view of the above.
Figure 15:
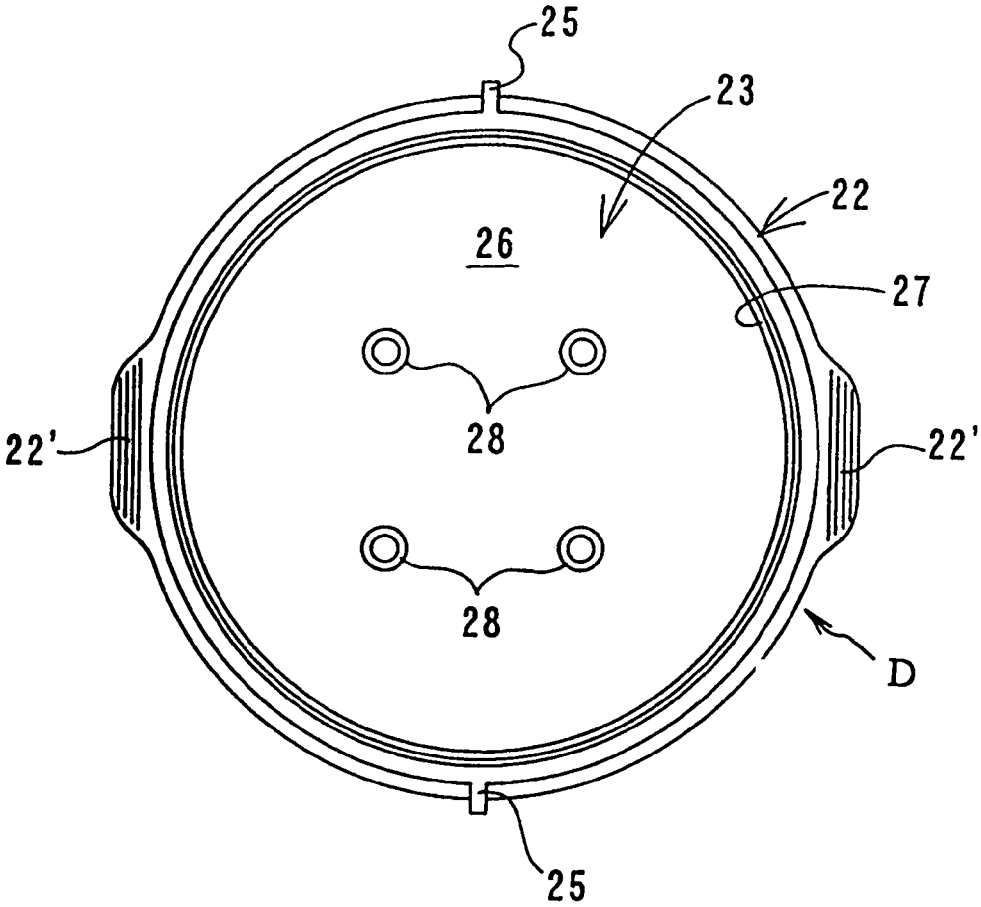
FIG. 15 is an under side view of the above.
Figure 16:
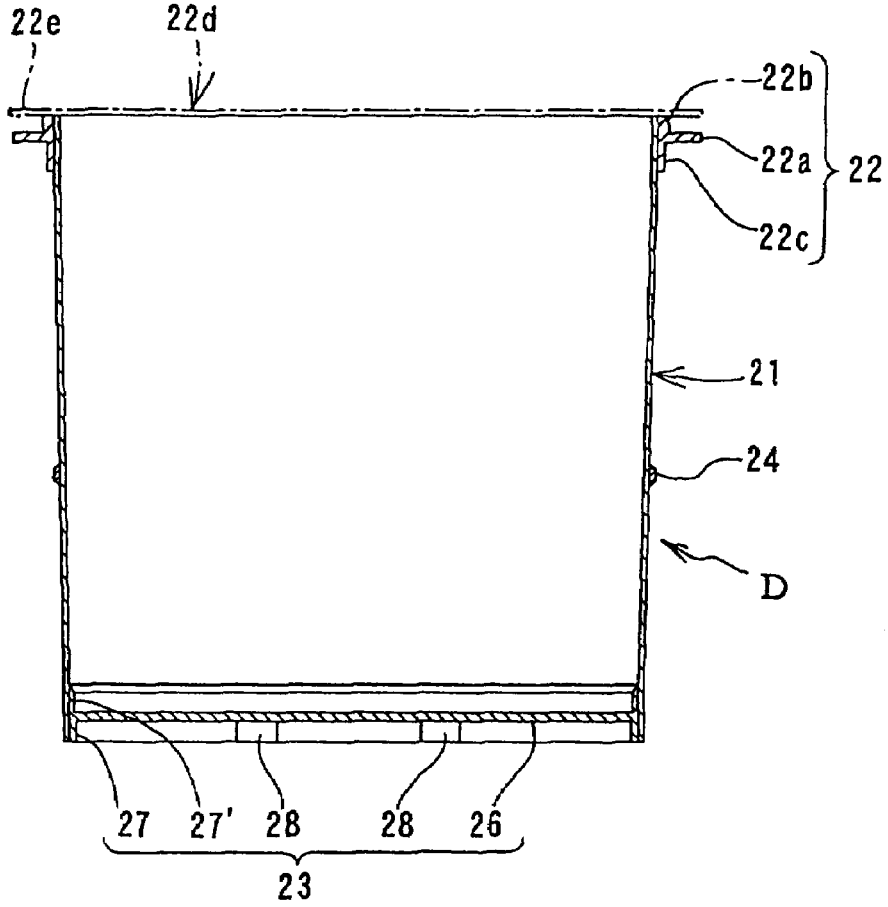
FIG. 16 is a vertical sectional view of the above.
Figure 17:
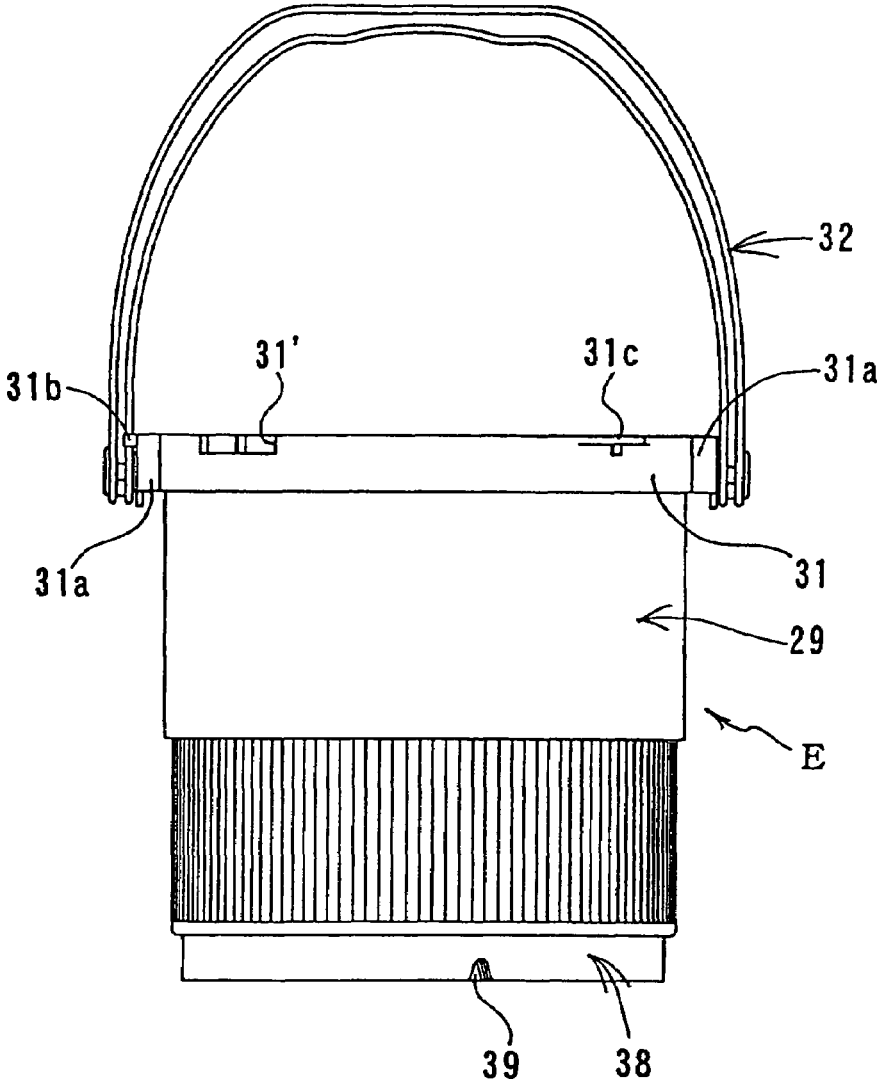
FIG. 17 is a front view of an external container relating to a second embodiment of the present invention.
Figure 18:
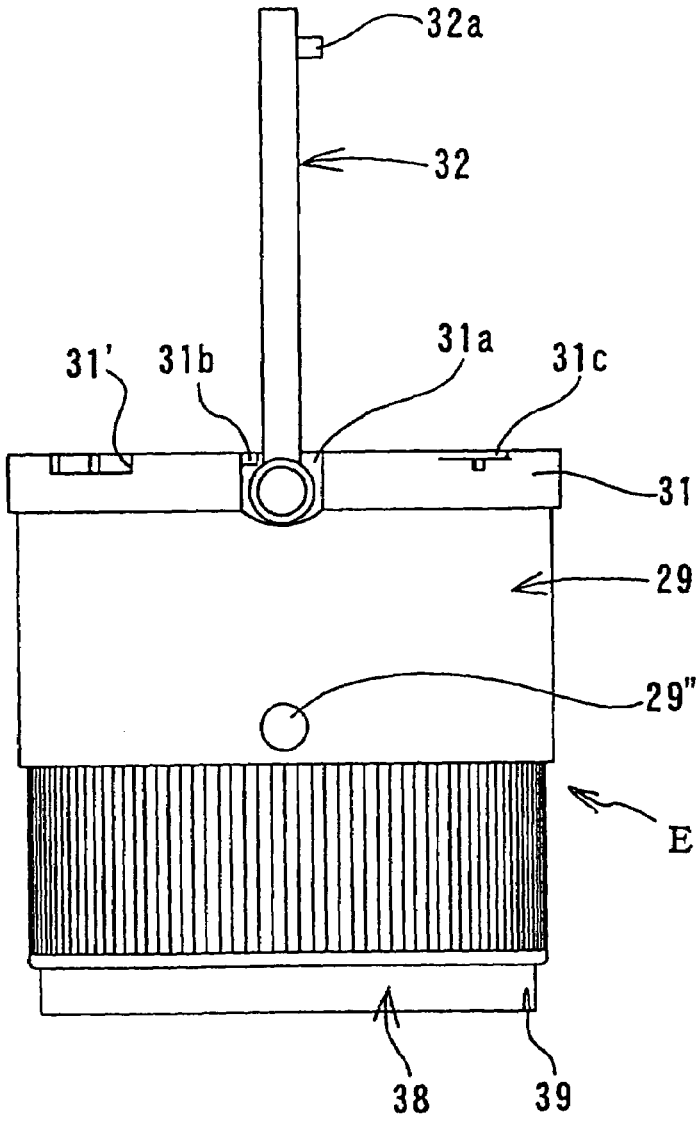
FIG. 18 is a side view of the above.
Figure 19:
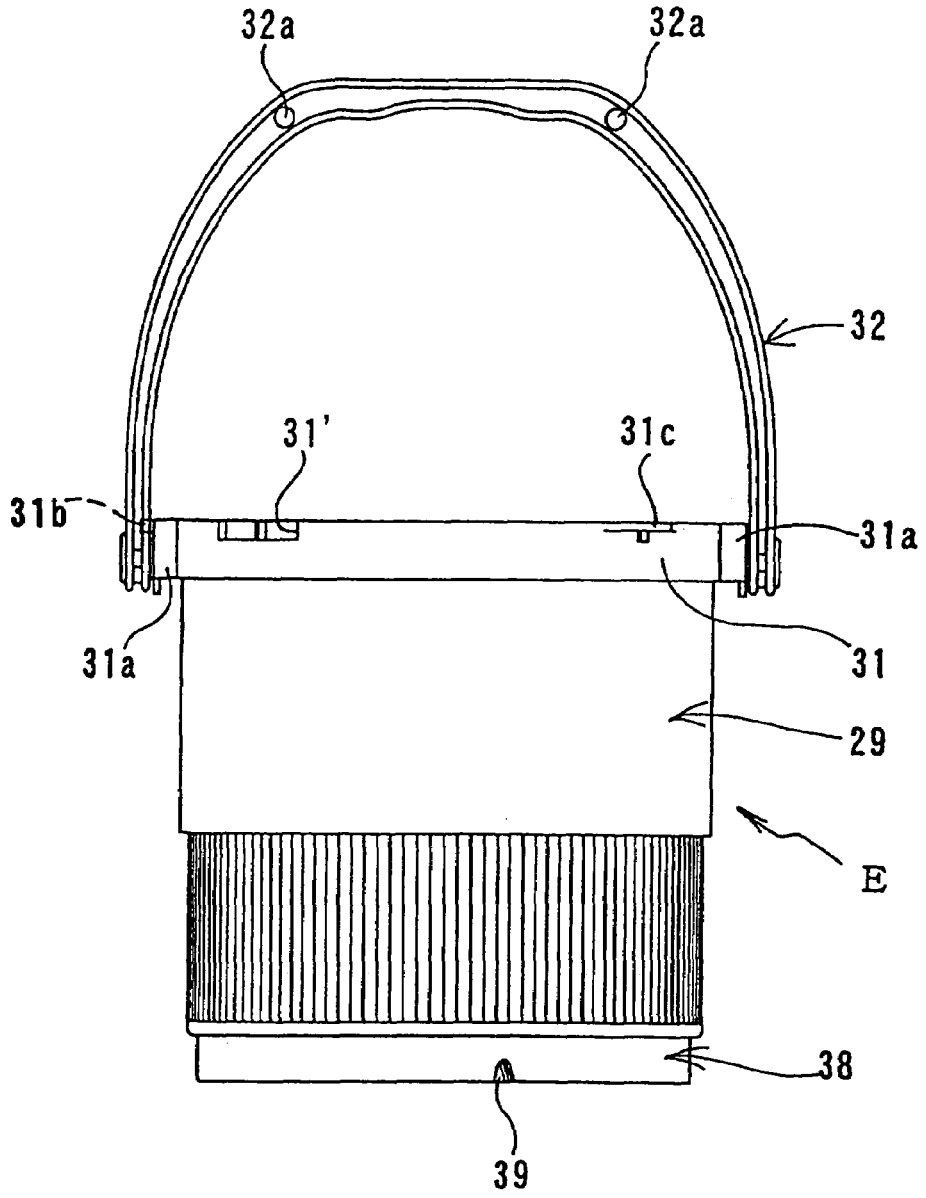
FIG. 19 is a rear view of the above.
Figure 20:
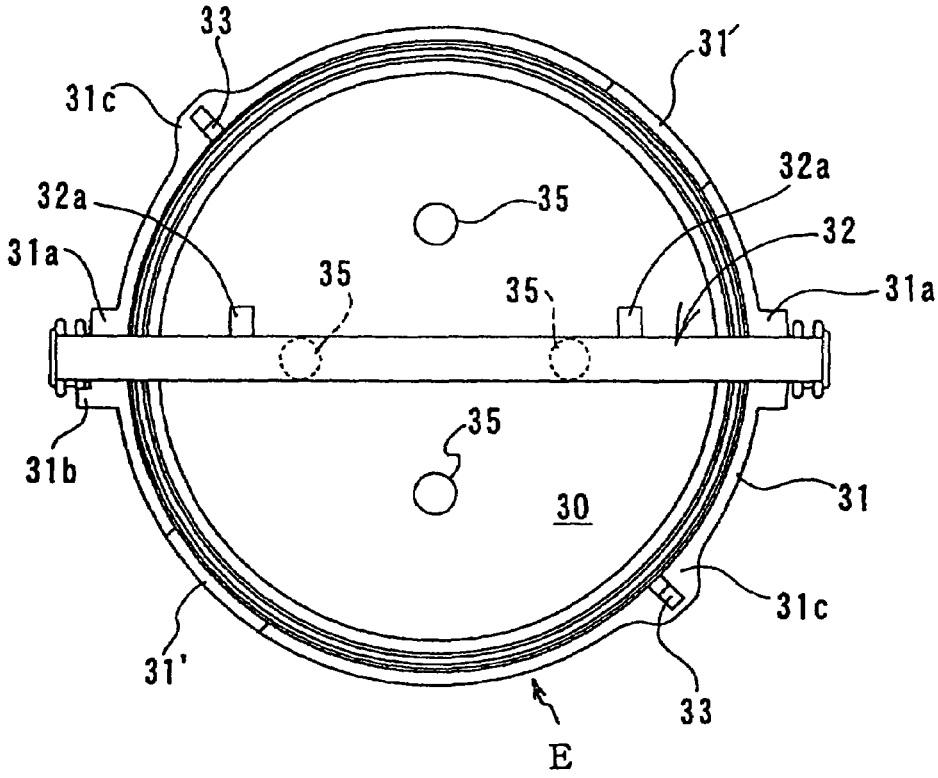
FIG. 20 is a plan view of the above.
Figure 21:
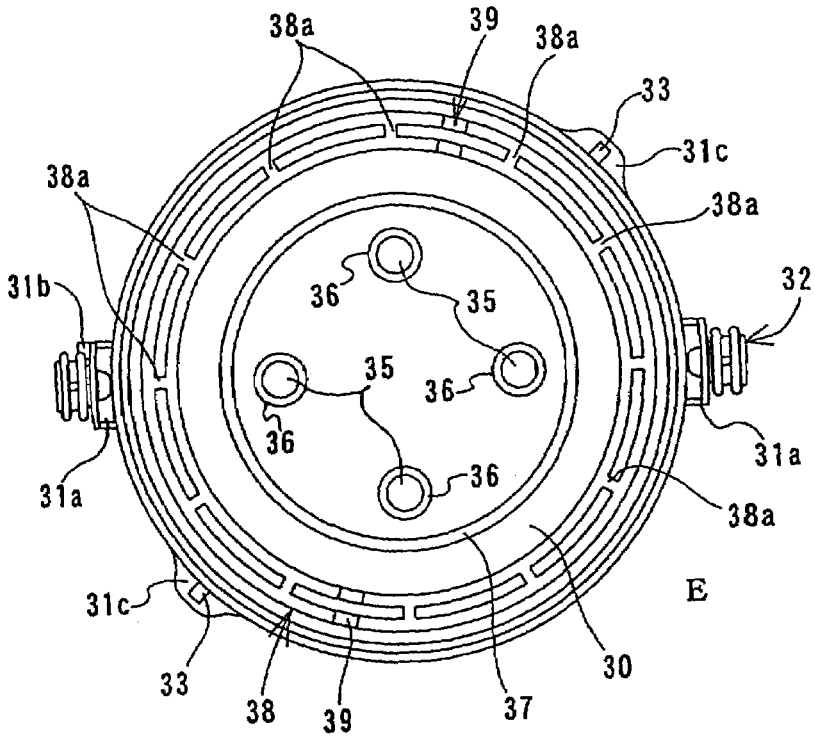
FIG. 21 is an under side view of the above
Figure 22:
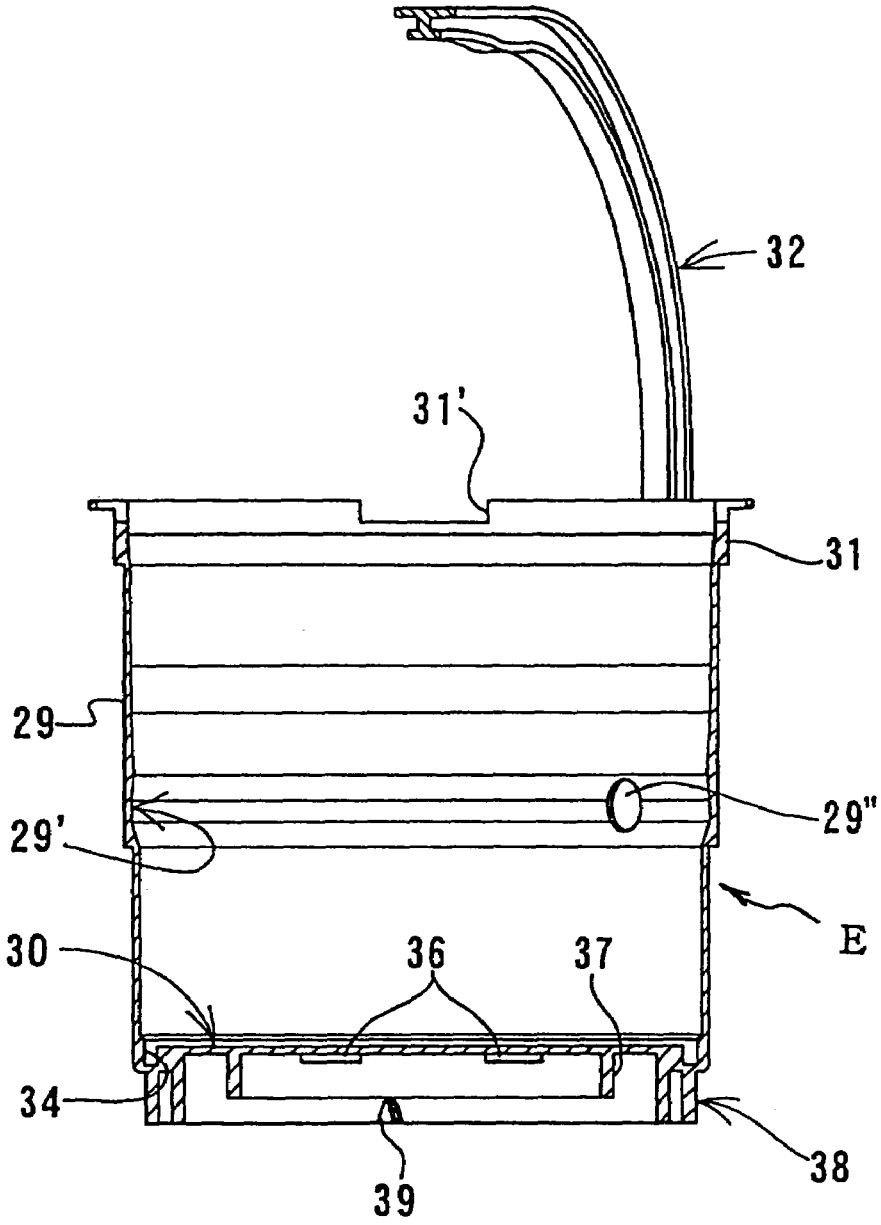
FIG. 22 is a vertical sectional view of the above.

For example, a plurality of fastening means 19 of an attached chuck mechanism are provided in the mixing device C according to the present invention, whereby the lower half portion of the external container B is fastened and fixed in position (FIG. 11).

Here, the fastening means 19 of a chuck mechanism is described as one embodiment of the present invention, but the invention is not limited to this and detachable fastening means 19 may also be used, such as plastic bands, metal fasteners, rubber bands, leather bands, or the like, provided that these fastening means 19 allow the external container B inserting the container A to be fastened and fixed to the mixing device C.

This plurality of fastening means 19 press the plurality of pressing pieces 17 of the trunk wall 9 of the external container B towards the inside, and as described above, cause the inner surfaces of the pressing pieces 17 to deform slightly towards the inside of the inner ring groove 14, thereby pressing the engaging wall 7 of the container A against the inner wall surface of the inner ring groove 14, and fixing strongly. More particularly, the fastening means 19 are able to press and fasten at least one of the pressing pieces 17 provided on the outer circumference of the circular bottom plate 10 of the external container B.

The lid member which closes the opening in the upper end of the container A is removed when the container A is fitted into the external container B, or after it is fitted into same, and a paddle 20 of the mixing device C is inserted to the container A.

Next, when the mixing device C is driven, the container A and the external container B perform a repeated reciprocal motion in the left and right-hand directions with the agitating platform 18 in a unified positional relationship, and the contents are mixed by means of this left and rightward swinging movement with respect to the paddle 20.

The aforementioned unified positional relationship of the container A and the external container B is maintained by the fact that the first engaging projections 5 in the ring-shaped rim frame 2 of the container A are engaged with the engaging recesses 13 of the ring-shaped rim section 11 of the external container B, and furthermore, the second engaging projections 8 of the bottom plate 3 of the container A are engaged with the engaging holes 15 of the circular bottom plate 10 in the external container B.

Twisting or crushing of the tubular main body 1 of the container during mixing is prevented not only by maintaining the aforementioned unified positional relationship, but also by the ring-shaped trunk section frame 4 which is formed integrally with the external circumferential surface of the tubular main body 1 in approximately the middle region thereof.

Furthermore, rising up of the lower half of the container A (the tubular main body 1) during mixing is prevented by the fact that the lower half of the external container B is fastened and fixed by the fastening means 19 of a chuck mechanism of the mixing device C, and the fact that the pressing pieces 17 in the trunk wall 9 of the external container B press the engaging wall 7 of the container A against the wall surface of the inner ring groove 14, thereby fixing strongly.

It can also be seen that a further contribution to preventing rising up of the lower half of the container A (tubular main body 1) is provided by the fact that, in addition to the aforementioned fastening and fixing, the second engaging projections 8 of the bottom plate 3 of the container A are inserted into the engaging holes 15 in the circular bottom plate 10 of the external container B.

Second Embodiment

Next, a second embodiment of the present invention will be described in detail with reference to FIGS. 12 to 27.

Symbol D in the drawings is a flexible container made of soft plastic. This container D comprises a tubular main body 21 of a prescribed plastic laminate film and a plastic ring-shaped rim frame 22 onto the upper end of a tubular main body 21, which decreases gradually in diameter from the upper end opening thereof towards the lower end opening thereof, in such a manner that the ring-shaped rim frame 22 and the tubular main body 21 form an integrated body, in addition to which, a plastic bottom plate 23 is affixed to the lower end opening of the tubular main body 21; and at least one ring-shaped trunk section frame 24 having a band-shape, made from plastic, metal, leather, cloth, or the like, is formed on the outer circumferential surface of the tubular main body 21. In the container according to the present embodiment, one plastic ring-shaped trunk section frame 24 is provided integrally with the outer circumferential surface of the tubular main body 21 in approximately the middle portion thereof in the height direction.

As described above, this container D generally has a similar composition to that of the container A according to the first embodiment, but the aforementioned ring-shaped rim frame 22 and bottom plate 23 differ from those of the container A and these elements are as described below.

The aforementioned ring-shaped rim frame 22 is formed in a ring having a laterally-oriented T-shaped cross-section, in which an upper rib 22*b* and a lower rib 22*c* are continuously formed on the inner circumferential edge of a brim section 22*a*. The inner surfaces of the upper rib 22*b* and the lower rib 22*c* are fixed to the tubular main body 21.

A pair of grips 22', 22' are formed in a projecting member at mutually opposing positions on the brim -section 22*a*. Furthermore, a plurality of first engaging projections 25 are formed in a projecting member at a prescribed interval, for example, an interval of 180°, on the outer circumferential surface of the lower rib 22*c*.

Moreover, the bottom plate 23 comprises a circular plate 26 and an engaging wall 27 formed below the outer circumference of the circular plate 26, a plurality of second engaging projections 28 being formed integrally with the back side of the circular plate 26 of the bottom plate, and an upper rib 27' of the same diameter as the aforementioned engaging wall 27 being formed above the outer circumference of the circular plate 26. The presence of the upper rib 27' increases the strength of the bottom plate 23 with respect to the bottom plate 3 of the first embodiment, and also adhesives strongly with the tubular main body 21 without damage or breakage.

This container D is filled with a prescribed viscous liquid, whereupon a prescribed lid member 22*d* made from aluminum laminate film, or the like, is bonded or heat-sealed onto the upper end of the upper rib 22*b* of the ring-shaped rim frame 22, thereby closed up the upper end opening. The container D is then accommodated inside a packaging box, and in this state, it is supplied for carrying, delivery, transportation or storage.

The lid member 22*d* is formed, for example, in a flat square shape to a sufficiently larger size than the upper end opening of the container and it has an extending section 22*e* which extends to the outer side of the upper rib 22*b* (see FIG. 16), when open the lid member 32*d* of the container, the lid member 22*d* can be peeled by gripping this extending section 22*e*.

Furthermore, the upper rib 22*b* portion of the ring-shaped rim frame 22 is fixed inside surface of the upper end of the tubular main body 21 and can serve as a spatula scraping rib which is used to remove surplus contents adhering to a spatula employed to remove contents from the container.

When the contents have been used up and the container has become empty, by crushing the container in such a manner that the ring-shaped rim frame 22 and the bottom plate 23 move towards each other, or come into contact with each other, the tubular main body 21, which assumes a folded state, so that the ring-shaped trunk section frame 24, the ring-shaped rim frame 22 and the bottom plate 23 become folded up together, the height of the container is reduced to small fraction of its original height, and hence the volume of the resulting industrial waste can be reduced (not illustrated).

Symbol E in the drawings indicates an external container made from a hard plastic.

This external container E comprises a difference in level in the outer circumferential surface thereof, and is constructed in such a manner that the underside has a smaller diameter than the upper side. Furthermore, the external container E is formed with a trunk wall 29 having a large diameter section 29' on the inner surface in approximately the middle portion thereof in the height direction, and a bottom plate 30, and the external container E is of the required size for inserting the container D.

Peep holes 29", 29" are provided in mutually opposing positions in the large diameter section 29' of the trunk wall 29, and a plurality of vertical lines are formed on the outer circumferential surface of the trunk wall 29, on the lower half underside from the aforementioned difference in level at which the diameter decreases. Accordingly, the outer circumference of the trunk wall 29 has an undulating wave shape in lower half underside.

Furthermore, a ring-shaped rim section 31 is formed on the upper end of the trunk wall 29, lifting handle attachment sections 31*a*, 31*a* are formed in a projecting member at mutually opposing positions on this ring-shaped rim section 31, and a lifting handle 32 is attached rotatably to these lifting handle attachment sections 31*a*, 31*a*.

Numeral mark 31*b* is a projecting piece 31*b* formed at a lifting handle attachment section 31*a*, the lifting handle 32 can be maintained in an upright state by being raised and engaged with this projecting piece 31*b*.

Numeral mark 32*a* and 32*a* are a pair of bag hanging projections formed in a projecting member at a prescribed interval apart on the middle linear portion of the lifting handle 32. These bag hanging projections 32*a*, 32*a* are used to hang containers, such as bags, containing prescribed material used in mixing, such as hardening agent, toner, or the like, when the lifting handle 32 is maintained in an upright state. By opening the lower ends of containers hanging from these projections 32*a*, 32*a*, the content used in mixing can be caused to pour downwards and become added to the contents of the container D that is fitted into the external container E.

Moreover, a plurality of engaging recesses 33, 33 into which the first engaging projections 25, 25 of the container D are inserted and engaged are formed in broad sections 31*c*, 31*c* formed in mutually opposing positions on the ring-shaped rim section 31. Furthermore, cutaway sections 31', 31' on the upper end side are formed in the ring-shaped rim section 31 in positions corresponding to the aforementioned grips 22', 22' of the container D.

The bottom plate 30 formed integrally with the trunk wall 29 forms a false bottom, and furthermore, between the inner surface of the trunk wall 29 and the circular bottom plate 30, an inner ring groove 34 is formed into which the aforementioned engaging wall 27 in the bottom plate 23 of the container D is inserted and engaged. Moreover, a plurality of engaging holes 35 for inserting and engaging the plurality of second engaging projections 28 of the container D are provided at prescribed locations in the circular bottom plate 30.

Numeral mark 36 indicates engaging hole 35 reinforcing walls formed on the back side of the circular bottom plate 30 at the edge sections of the openings of the aforementioned engaging holes 35, and numeral mark 37 indicates a ring-shaped reinforcing member formed on the back side of the circular bottom plate 30 to the outer side of the engaging holes 35.

Numeral mark 38 indicates a ring-shaped plinth formed on the back side of the circular bottom plate 30 to the outer side of the ring-shaped reinforcing member 37. This plinth 38 is formed by connecting a ring-shaped dual wall by means of a plurality of reinforcing ribs 38*a* and it is higher than the ring-shaped reinforcing member 37. Numeral marks 39, 39 indicate air holes provided passing through the dual wall of the plinth 38.

Figure 23:
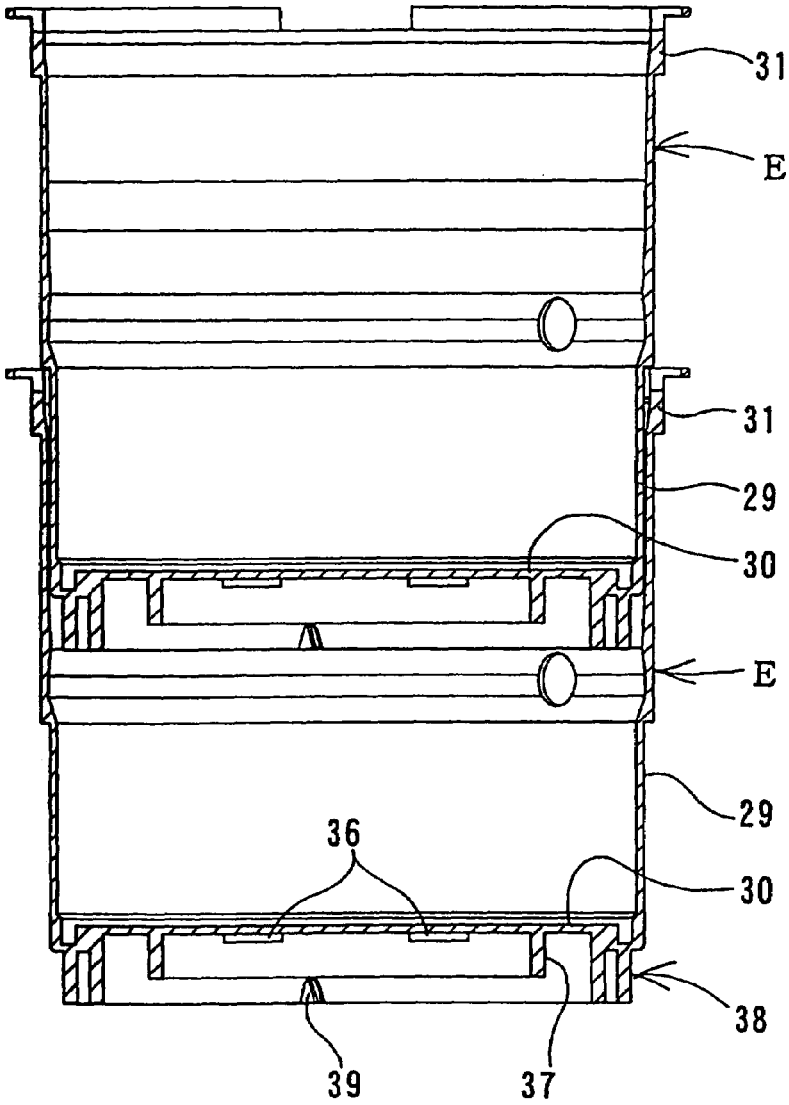
FIG. 23 is a vertical sectional view of two external containers relating to the second embodiment in a superimposed state.
Figure 24:
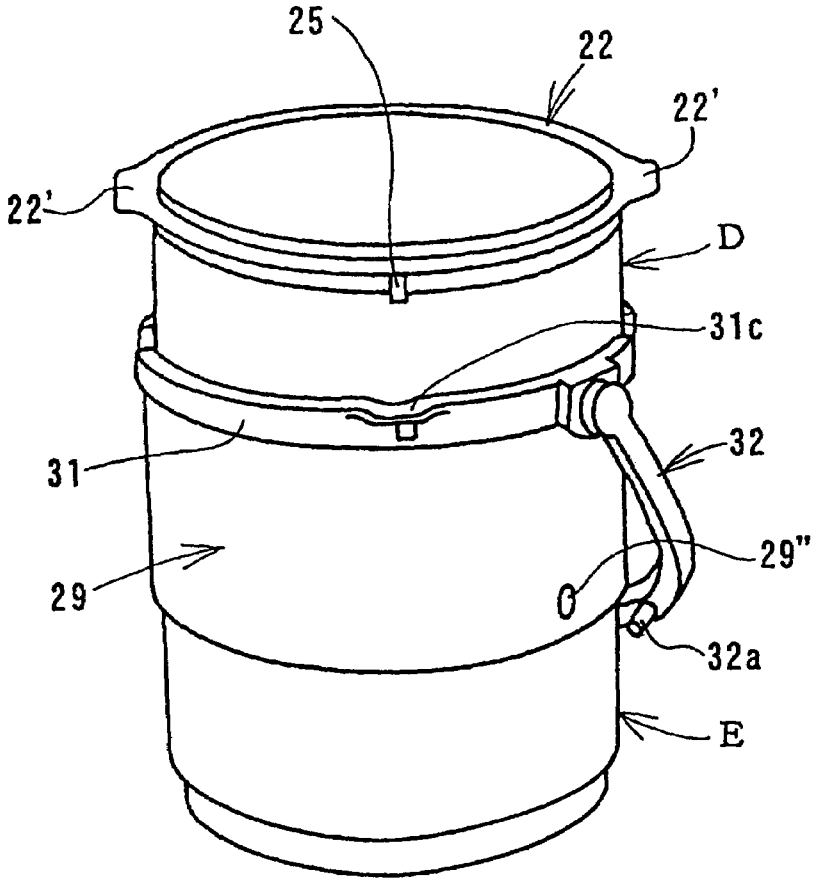
FIG. 24 is a perspective view of a container relating to the second embodiment in a state during insertion into the aforementioned external container relating to the second embodiment.
Figure 25:
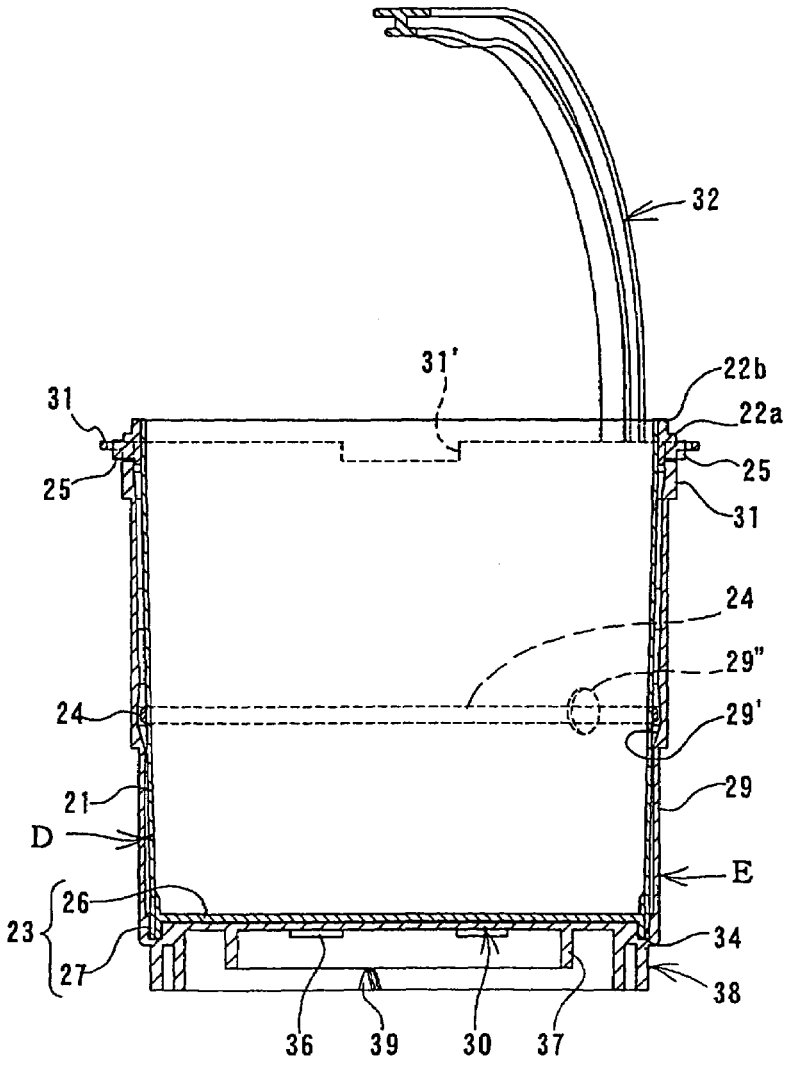
FIG. 25 is a sectional view of the aforementioned container relating to the second embodiment in a state after insertion into the aforementioned external container relating to the second embodiment.

By providing a difference in level in the outer circumferential surface of the external container E, the external diameter at the lower half underside is smaller than the internal diameter at the upper half side, and therefore, when a plurality of external containers E are stacked together, then they can be placed one on top of another in a state where the lower half of the trunk wall 29 of an upper external container E is fitted inside the external container E positioned below it, the difference in level section of the upper external container E becoming mounted on the ring-shaped rim section 31 of the trunk wall 29 of the lower external container E (see FIG. 23).

Furthermore, since the plinth 38 comprises a dual wall structure, and since engaging hole reinforcing walls 36 are formed at the edge sections of the openings of the engaging holes 35, then the strength in the vicinity of the circular bottom plate 30 is high.

Moreover, the container D is filled with a prescribed viscous liquid, closed up, and it is accommodated in a packaging box, such as a cardboard box, and supplied for carrying, delivery, transportation or storage. However, if a general viscous liquid is used, then the container D may be taken out from the aforementioned packaging box, inserted into the external container E, and the viscous liquid may be subjected to mixing, by means of a mixing device C.

The container D is inserted into the external container E in the following manner.

Figure 26:
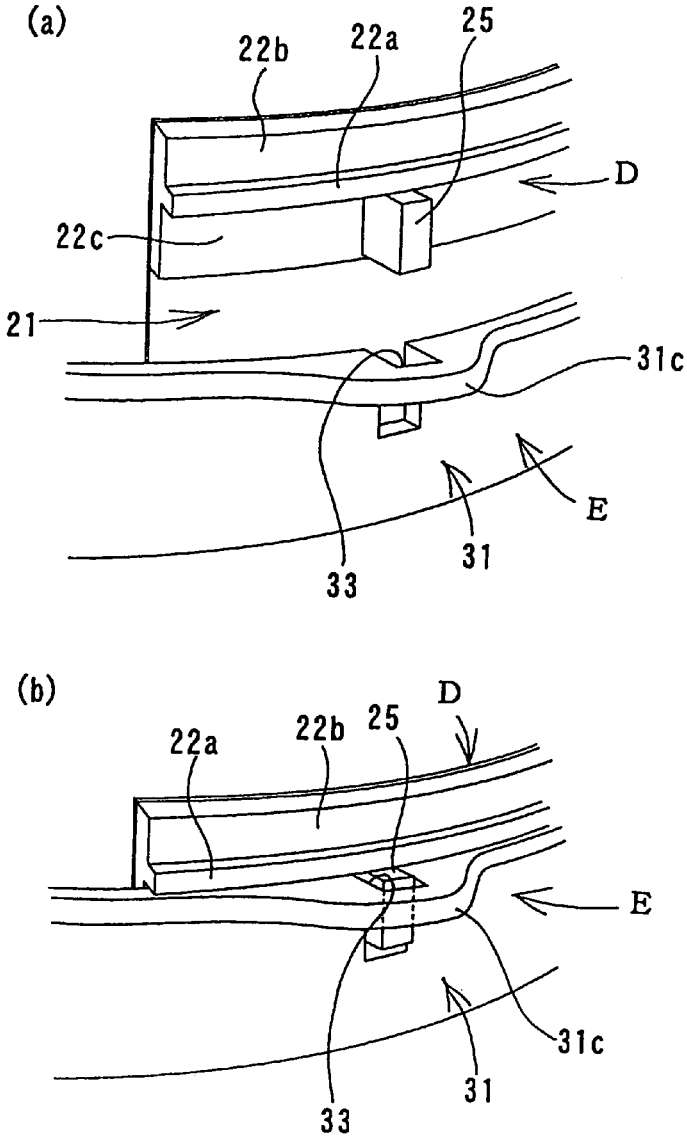
FIGS. 26A and B are perspective diagrams of a principal part for describing the state of engagement between the aforementioned container and the opening on the upper end of the external container.

Specifically, in a state where the ring-shaped rim frame 22 of the container D is mounted on the ring-shaped rim section 31 of the external container E, the first engaging projections 25, 25 are aligned with and inserted into the engaging recesses 33, 33 (see FIG. 26).

Accordingly, the engaging wall 27 and the plurality of second engaging projections 28 of the container D are respectively inserted into the inner ring groove 34 and the plurality of engaging holes 35 of the external container 3 and become engaged closely, and the bottom plate 23 (circular plate 26) of the container D becomes joined with the circular bottom plate 30 of the external container B.

Figure 27:
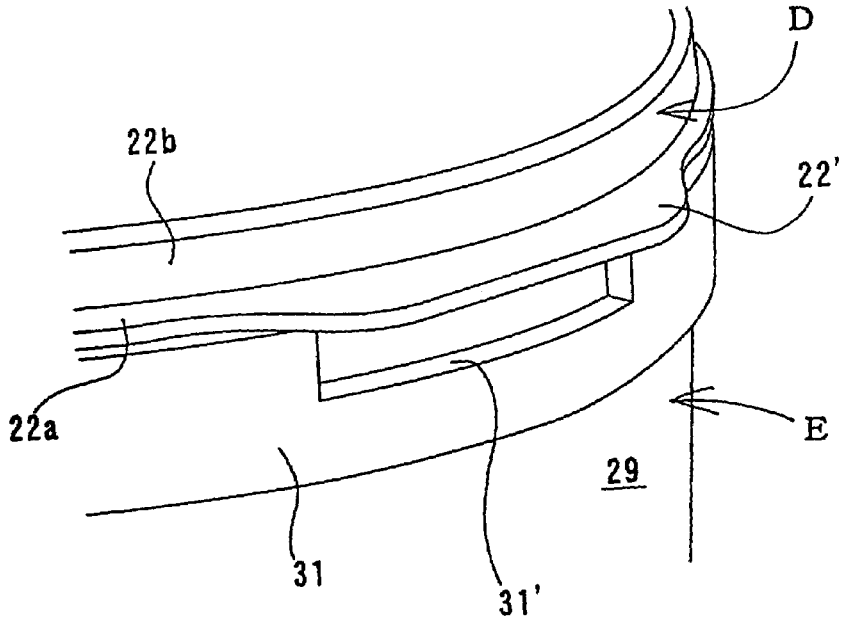
FIG. 27 is a perspective diagram of a principal part for describing the positional relationship between a grip of the aforementioned container and a cutaway section of the external container.

Furthermore, the grips 22', 22' of the container D assume a position above the cutaway sections 31', 31' of the external container E (see FIG. 27).

Moreover, since the ring-shaped trunk section frame 24 of the container D is positioned corresponding to the large diameter section 29' of the external container E (see FIG. 25), then it is possible to confirm whether the container D is fitted correctly by the ring-shaped trunk section frame 24 which can be seen through the peep holes 29".

When fitting the container D, the air inside the external container E for mixing and transportation E is expelled via the engaging holes 35 in the circular bottom plate 30 and the air holes 39, 39 in the plinth 38, and therefore the fitting operation can be performed smoothly.

In order to agitate the viscous liquid, similarly to the first embodiment described above, the external container E having the container D fitted therein is mounted onto the agitating platform 18 of a commonly known mixing device C as illustrated in FIG. 11, for example, and at least one portion of the trunk wall of the external container is fastened by a plurality of fastening means 19, thereby fixing the external container to the agitating platform 18, in a detachable condition.

Here, similarly to the first embodiment described above, the fastening means 19 may be detachable fastening means, such as plastic bands, metal fasteners, rubber bands, leather bands, or the like, provided that these fastening means allow the external container having the container inserted therein to be fastened and fixed to the agitating platform of the mixing device.

The lid member which closes up the opening in the upper end of the container D is removed when the container D is fitted into the external container E, or after it is fitted into same, and a paddle 20 of the mixing device C is inserted and set in position in the container D, via the opening in the upper end thereof.

Thereupon, when the mixing device C is driven, the container D and the external container E perform a repeated reciprocal motion in the left and right-hand directions with the agitating platform 18 in a unified positional relationship, and the viscous liquid is mixed by means of this left and rightward agitating movement with respect to the paddle 20.

The aforementioned unified positional relationship of the container D and the external container E is maintained by the fact that the first engaging projections 25, 25 in the ring-shaped rim frame 22 of the container A are engaged with the engaging recesses 33, 33 of the ring-shaped rim section 31 of the external container E, and furthermore, the second engaging projections 28 of the bottom plate 23 of the container D are engaged with the engaging holes 35 of the circular bottom plate 30 in the external container B.

Twisting or crushing of the tubular main body 21 of the container D during mixing is prevented not only by maintenance of the aforementioned unified positional relationship, but also by the ring-shaped trunk section frame 24 which is formed integrally with the external circumferential surface of the tubular main body 21 in approximately the middle region thereof.

Furthermore, it is confirmed that rising up of the lower half of the container D (tubular main body 21) is suppressed by the second engaging projections 28 of the bottom plate 23 of the container D inserting into and engaging with the engaging holes 35 in the circular bottom plate 30 of the external container E.

Since the grips 22', 22' of the container D that is fitted into the external container E are positioned over the cutaway sections 31', 31' of the external container E, then the container D can be lifted up and removed readily after use, by inserting a finger along the lower surface of the grips 22', 22' via the cutaway sections 31', 31' and then lifting them upwards.

The invention claimed is:

1. A container wherein a ring-shaped rim frame made of plastic is provided on an opening at the upper end of a flexible tubular main body which can be disposed by crushing in a lengthwise direction, a bottom plate made of plastic is fitted onto an opening at the lower end thereof, and at least one ring-shaped trunk section frame is provided on the outer circumferential surface of said tubular main body, in addition to which, a plurality of first engaging projections are formed integrally with said ring-shaped rim frame in a projecting member at prescribed intervals, a downwardly extending engaging wall is formed integrally with the outer circumferential edge of said bottom plate, and a plurality of second engaging projections are formed at prescribed positions integrally with bottom plate.

2. The container according to claim 1, wherein a plurality of first engaging projections are formed integrally with said ring-shaped rim frame in a projecting member toward an outer side at prescribed intervals.

3. The container according to claim 1, wherein said tubular main body is made of a plastic laminate film.

4. The container according to claim 1 or 3, wherein said ring-shaped rim frame has a laterally-oriented T-shaped cross-section in which an upper rib and a lower rib are continuously formed on the inner circumferential edge of a brim section, and said bottom plate comprises a circular plate of a bottom plate and an upper side rib extending upwards from the external circumferential edge of the circular plate of the bottom plate.

5. The container according to claim 4, wherein grips are formed in a projecting member on the brim section of said ring-shaped rim frame.

6. An external container detachably fitted onto the container according to claim 1 or 3 and used for mixing the contents of the container and transporting the container, wherein the external container comprises a trunk wall and a circular bottom plate made of hard plastic, a plurality of engaging recesses into which the first engaging projections of the container can be fitted are formed at prescribed intervals on a ring-shaped rim section formed on the upper end section of the trunk wall, in addition to which, an inner ring groove into which the engaging wall of the container can be engaged is formed in the boundary region between said trunk wall and the circular plate of the bottom plate, and a plurality of engaging holes into which the second engaging projections of the container can be engaged are formed at prescribed positions in said circular bottom plate.

7. The external container according to claim 6, wherein peep holes are provided at prescribed positions in said trunk wall.

8. The external container according to claim 6, wherein air holes are provided in a plinth formed on the circular bottom plate.

9. The external container according to claim 6, wherein cutaway sections which are open on the upper end side are formed on said ring-shaped rim section.

10. The external container according to claim 6, wherein a difference in level is provided in the outer circumferential surface of said trunk wall, and the external diameter at the lower end side is made smaller than the internal diameter at the upper end opening side thereof.

11. The external container according to claim 6, wherein a lifting handle having bag hanging projections is attached rotatably to said ring-shaped rim section, and a projecting piece for supporting said lifting handle in an upright state is also formed thereon.

12. A mixing device having an agitating platform for fixing the external container according to claim 6 into which said container is fitted, for mixing the contents of the container by causing the external container and the container to agitating in unison with the agitating platform; the mixing device further comprises a plurality of fastening means for fastening the trunk wall of said external container, thereby detachably fixing the external container to the agitating platform.

* * * * *